US007101324B2

(12) United States Patent
Matos

(10) Patent No.: US 7,101,324 B2
(45) Date of Patent: Sep. 5, 2006

(54) PORTABLE EXERCISE APPARATUS

(76) Inventor: Jose Matos, 1 Columbus St., New Windsor, NY (US) 12553

( * ) Notice: Subject to any disclaimer, the term of this patent is extended or adjusted under 35 U.S.C. 154(b) by 518 days.

(21) Appl. No.: 10/639,681

(22) Filed: Aug. 13, 2003

(65) Prior Publication Data

US 2005/0037905 A1 Feb. 17, 2005

(51) Int. Cl.
*A63B 23/04* (2006.01)

(52) U.S. Cl. ..... 482/124; 482/121; 297/51; 297/52

(58) Field of Classification Search ..... 482/121–129, 482/140, 142, 130; 5/662, 114, 116
See application file for complete search history.

(56) References Cited

U.S. PATENT DOCUMENTS 1,344,431 A * 6/1920 Albertie ..... 297/440.11
1,422,319 A * 7/1922 Stoll ..... 297/440.16
3,558,131 A 1/1971 Dragon
3,664,666 A 5/1972 Lloyd
3,893,667 A 7/1975 Snyder, Jr. et al.
4,403,773 A * 9/1983 Swann ..... 482/130
4,595,232 A * 6/1986 Glenn et al. ..... 297/17
4,609,192 A * 9/1986 Bratcher ..... 482/142
4,993,706 A 2/1991 Wilkinson
5,112,287 A 5/1992 Brewer
5,232,426 A 8/1993 Van Straaten
5,429,413 A * 7/1995 Levy et al. ..... 297/45
5,484,368 A 1/1996 Chang
5,542,898 A * 8/1996 Wilkinson ..... 482/142
5,810,702 A 9/1998 Wilkinson
6,063,014 A 5/2000 Scoggins
6,110,083 A 8/2000 Riser
6,220,994 B1 * 4/2001 Rich ..... 482/123
6,245,001 B1 6/2001 Siaperas
6,299,569 B1 10/2001 Rich
6,634,998 B1 * 10/2003 Siaperas ..... 482/142

* cited by examiner

*Primary Examiner*—Jerome Donnelly
(74) *Attorney, Agent, or Firm*—Nixon & Vanderhye P.C.

(57) ABSTRACT

Portable exercise apparatus comprising a collapsible support bench having a pair of movably connected leg members at both ends thereof, the leg members being movable between a storage position wherein they are disposed adjacent to each other and an open support position wherein they are disposed at an angle to each other with their ends separated. Generally laterally extending and substantially parallel support rods are connected to and extend between the upper and lower portions of the leg members at both ends of the support bench. A seat member is movably connected to one of the adjacent upper support rods and is movable between a storage position wherein it is disposed adjacent and substantially parallel to the leg members when they are in the storage position, and a support position wherein it extends across the upper portions of the leg members when they are in the open position and is supported on the upper support rods. Attachment devices are mounted in spaced relation on the outer portions of the upper and lower support rods. Flexible and resilient resistance exercise members can be removably attached to different or selected attachment devices for the performance of different exercises on the support bench when the leg members and seat member are in the open support position.

20 Claims, 7 Drawing Sheets

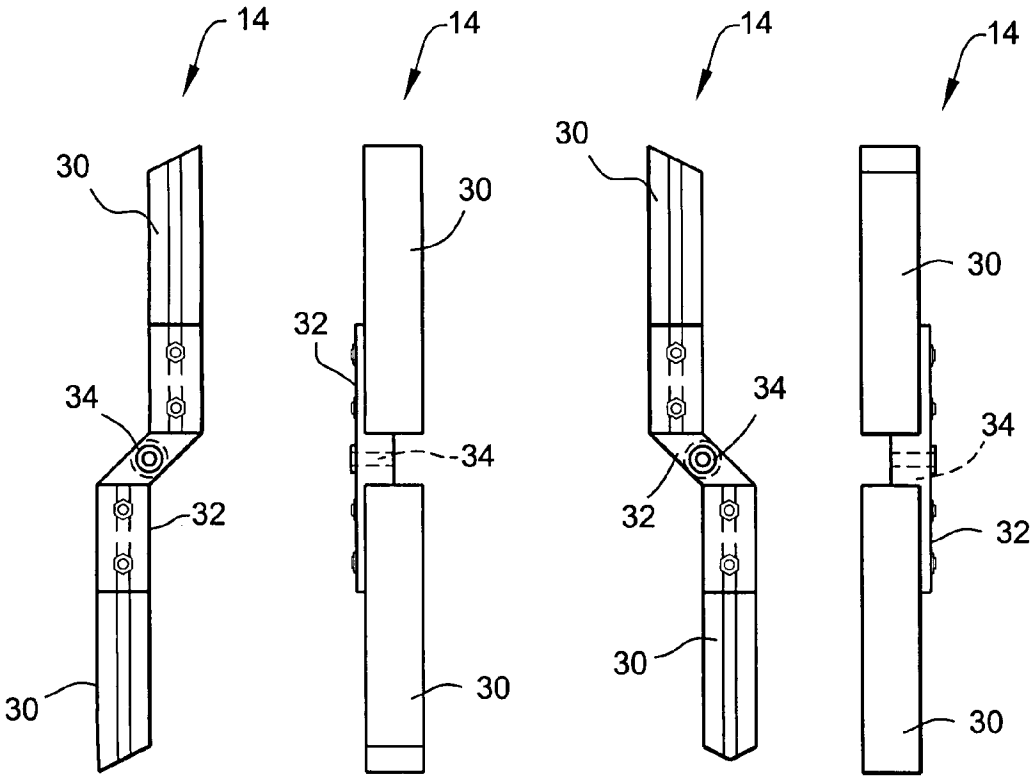
FIG. 4
FIG. 5
FIG. 6
FIG. 7
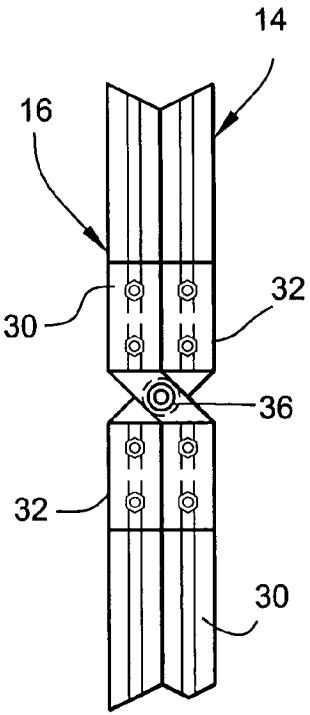
FIG. 8
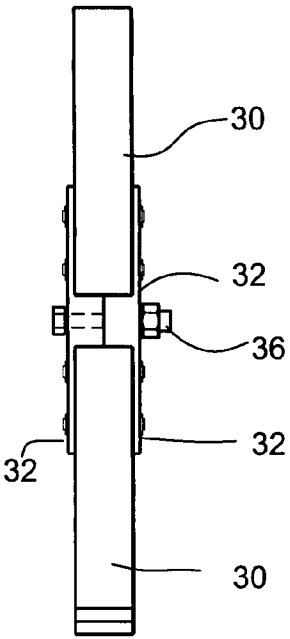
FIG. 9

PORTABLE EXERCISE APPARATUS

BACKGROUND OF THE INVENTION

1. Field of the Invention

The present invention relates to portable exercise apparatus and, more particularly, to such apparatus that is constructed to be easily movable between a collapsed or closed position and an open or support position wherein numerous exercise movements can be performed thereon.

2. Description of the Related Art

There are many types of exercise and fitness equipment currently used for rehabilitating certain muscle groups following surgery or injury, or for achieving and maintaining a desired fitness level. Such equipment usually comprises elaborate and specialized apparatus and devices that can be used effectively in gyms and fitness centers for controlled anaerobic exercises, which are movements based on resistance to tension or weights. Owing to cost and space requirements for storage and use, however, such specialized apparatus and devices are generally unavailable for home or private use.

Many persons would prefer to exercise privately or on their own schedules without travelling to a gym or fitness center. Although relatively simple exercise apparatus and devices are available for home or private use, they normally can be used only for a limited number of exercises and cannot duplicate the variety of controlled exercises which have been performed with more elaborate equipment at a gym or fitness center. Also, such home exercise devices have not been easily storable and have been difficult to move from one location to another.

Accordingly, there is a need for a portable exercise apparatus which enables many common anaerobic exercises to be performed in a private setting, that is small and lightweight enough to be easily moved to a desired location for use and then to be easily storable when not in use, and also, which is simple in construction to enable a variety of exercises to be performed without requiring numerous benches and/or large specialized machines. The present invention provides such an apparatus which meets these needs.

SUMMARY OF THE INVENTION

The portable exercise apparatus of the present invention comprises a collapsible support bench which can be easily moved between a storage position, wherein it takes up very little space, and an open or support position wherein it is very stable and can support a significant amount of weight.

The support bench comprises a pair of pivotally connected leg members at each end thereof that are movable between a closed position for storage and an open position for support. The pairs of leg members are connected at their upper and lower portions by longitudinally extending support rods that are secured thereto in any suitable manner. A seat member is movably connected to one of the support rods at the upper portion of the leg members and is movable between a closed or collapsed position wherein the seat member is disposed adjacent and substantially parallel to the collapsed leg members, and an open or support position wherein the seat member extends across the upper portions of the leg members and rests on the upper support rods when the leg members are in an open position.

Attachment members of any suitable construction are secured to the upper and lower support rods at various locations thereon for removable attachment to resistance tubing or the like for the performance of different types of exercises by a person supported on the bench.

BRIEF DESCRIPTION OF THE DRAWINGS

FIG. 4 is a front elevational view of one of the leg members at one end of the support bench of the present invention;

FIG. 5 is a side elevational view of the leg member shown in FIG. 4;

FIG. 6 is a front elevational view of the other leg member at one end of the support bench;

FIG. 7 is a side elevational view of the leg member shown in FIG. 6;

FIG. 8 is a front elevational view of the pair of leg members at one end of the support bench in a collapsed position;

FIG. 9 is a side elevational view of the leg members shown in FIG. 8;

DESCRIPTION OF THE PREFERRED EMBODIMENTS

Referring to FIGS. 1*a*–1*d*, 2 and 3, the portable exercise apparatus 10 of the present invention generally comprises a collapsible or foldable support bench 12 having pairs of pivotally connected leg members 14, 16 at both ends thereof that are connected at the upper and lower portions thereof by longitudinally extending support rods 18 of any suitable construction that are connected thereto in any suitable manner.

Figure 1D:
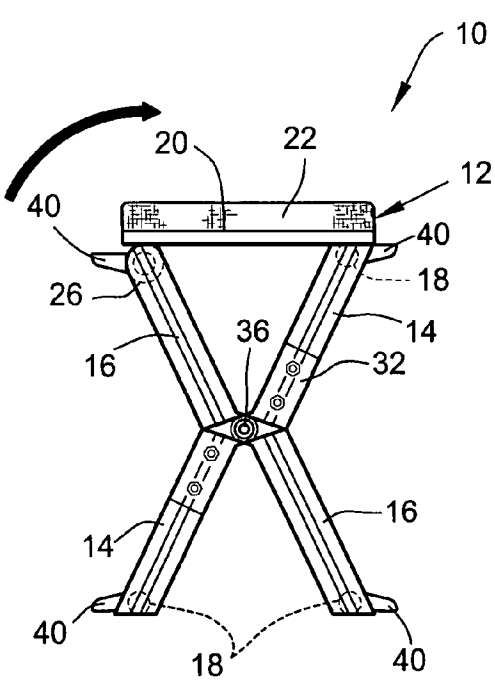
FIGS. 1*a*–1*d* are side elevational views of the portable exercise apparatus of the present invention, showing various stages of movement of the support bench between a closed or collapsed position and a fully open or support position.

An elongated seat member 20 extends between the pairs of leg members, 14, 16 and is movably connected to one of the upper support rods 18 in a manner to be more specifically described hereinafter, such that it is movable from the closed or collapsed position shown in FIG. 1*a* to the support or open position shown in FIG. 1*d* wherein the leg members 14 and 16 are moved to the open or support position and the seat member 20 rests on the upper support rods 18.

Figure 1C:
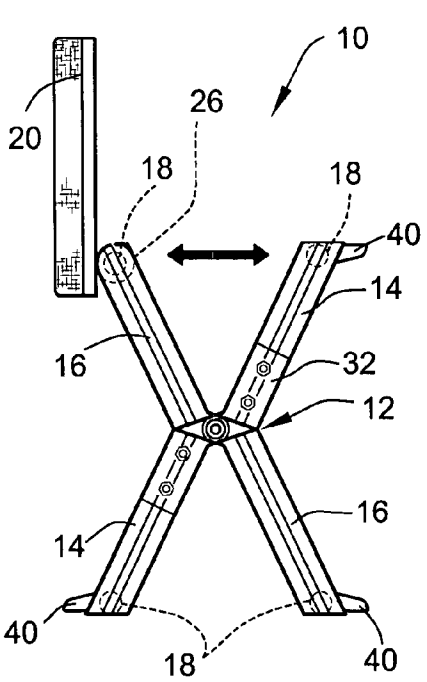
Figure 1B:
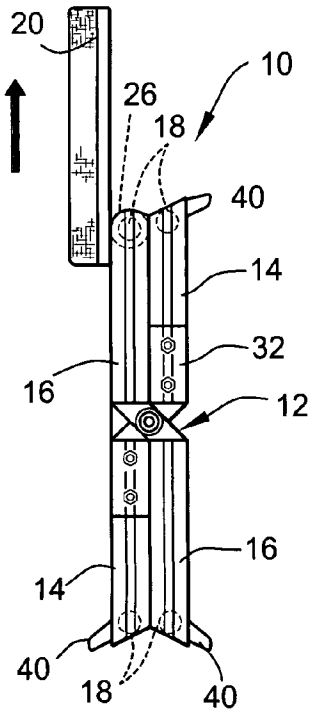
Figure 1A:
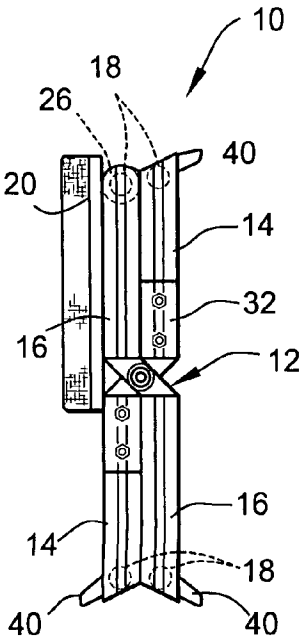
Figure 3:
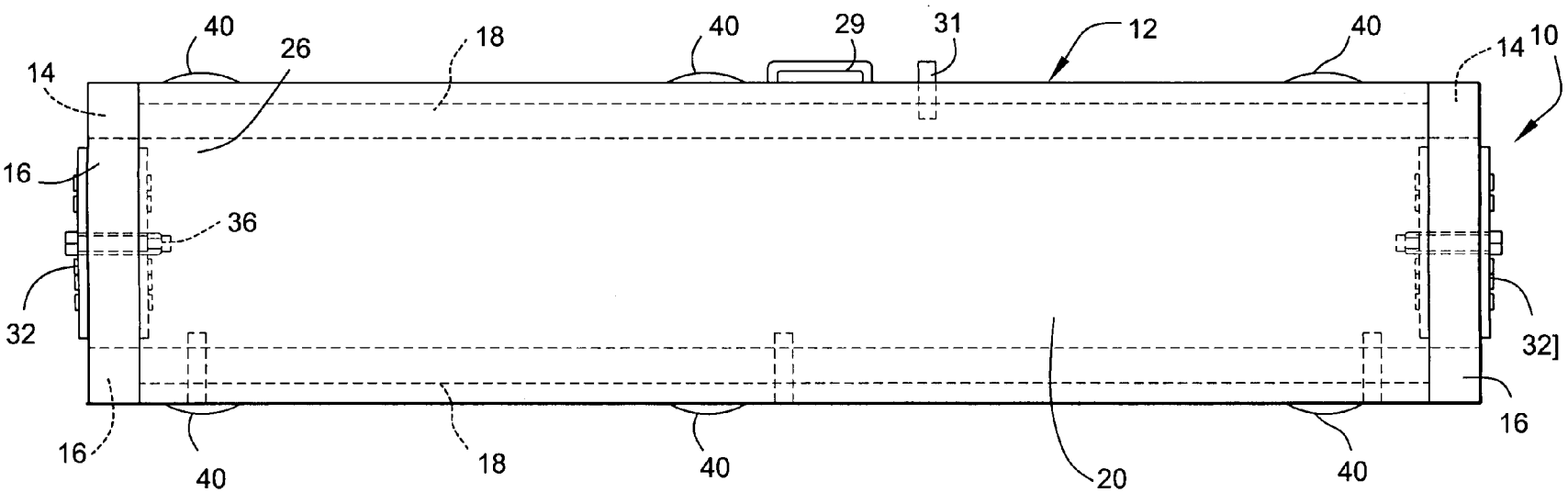
FIG. 3 is a top plan view similar to FIG. 2, showing the support bench in a fully open or support position.
Figure 11:
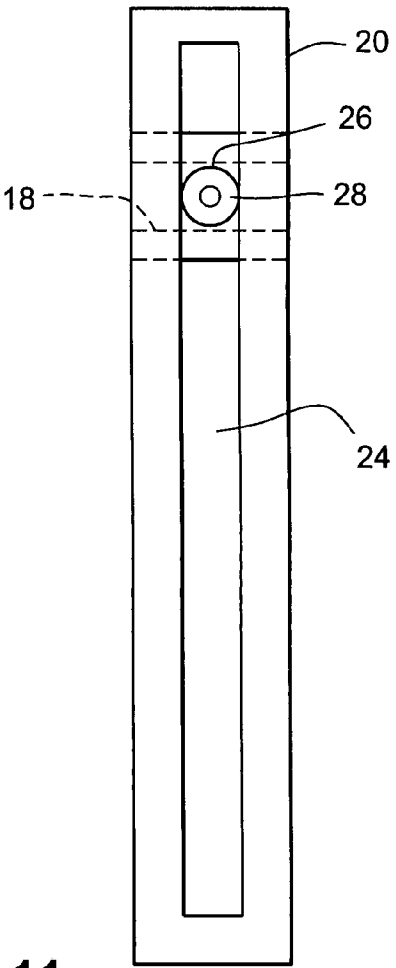
FIG. 11 is a front elevational view of a portion of the seat member that is movably connected to the adjacent upper support bar.
Figure 10:
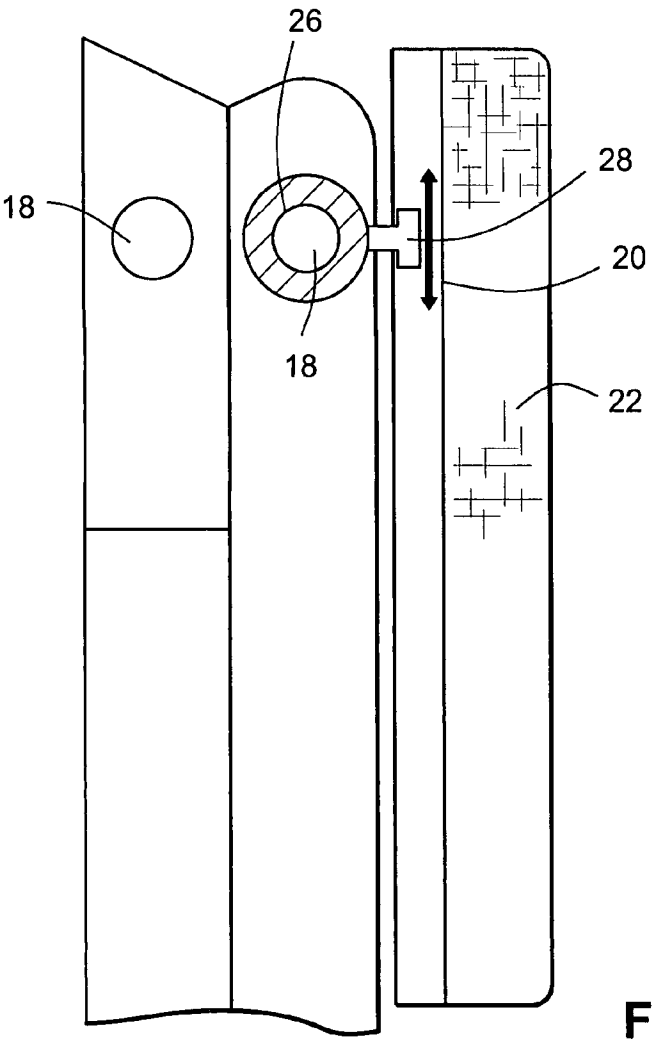
FIG. 10 is a side elevational view showing the support bench in a collapsed position and the manner in which the seat member is slidably and pivotally connected to the adjacent upper support rod.

As shown more specifically in FIGS. 10 and 11, the seat member 20 comprises a pad 22 of any suitable construction on the outer portion thereof, and a plurality of tracks 24 formed therein or mounted thereon, the tracks 24 extending substantially vertically when the seat member 20 is in the positions shown in FIGS. 1*a*, 1*b* and 1*c*. A plurality of pivot members 26 of any suitable construction are rotatably mounted on the upper support rod 18 disposed adjacent to the seat member 20. Each of the pivot members 26 has a pin 28 that is slidably mounted in the adjacent track 24 of the seat member. In this manner, the seat member can be moved between the storage position shown in FIG. 1*a*, wherein the leg members 12, 14 are in a collapsed or closed position and the seat member 20 is disposed adjacent and substantially parallel to the leg members, and the open or support position shown in FIG. 1*d* wherein the leg members 14, 16 are pivoted to an open position and the seat member 20 extends substantially horizontally across the upper portion of the leg members and rests on the upper support rods 18. To move from the position shown in FIG. 1*a* to that shown in FIG. 1*d*, the seat member 20 is slidably moved upwardly on the pins 28 in the tracks 24 thereof to the position shown in FIG. 1*b*. Thereafter, the leg members 14, 16 are moved to the open position shown in FIG. 1*c* and the seat member 20 is rotated in a clockwise position via the pivot members 26 rotatably mounted on the adjacent upper support rod 18 until the seat member 20 reaches the support position shown in FIG. 1*d* wherein it rests on the upper support rods 18. As shown in FIG. 3, the seat member 20 may be provided with a handle 29 and a movable pin 31 of any suitable construction for engaging the adjacent support rod 18 or an aperture therein to retain the seat member in the support position.

In the position shown in FIG. 1*d*, the support bench 12 is in a support position wherein it can be used for the various exercises that are within the scope of the subject portable exercise apparatus to be more fully described hereinafter. After use of the support bench, it can be collapsed or folded to the storage position shown in FIG. 1*a* by reversing the steps shown for the movement of the leg members 14, 16 and seat member 20 shown in FIGS. 1*a*–1*d*. Very simply, the seat member 20 is pivoted in a counter-clockwise direction to a substantially vertical position, the leg members are pivoted to the closed position shown in FIG. 1*b*, and the seat member 20 is slidably moved downwardly to the storage position shown in FIG. 1*a*. It will be readily seen, therefore, that the new and improved seat member 12 of the present invention is easily movable between the storage position shown in FIG. 1*a* wherein it is very compact and the open or support position shown in FIG. 1*d* wherein it provides a stable support for a person performing exercises on the subject portable exercise apparatus.

It is noted that the seat member 20 may be movably connected to the pairs of leg members 14, 16 and adjacent support rod 18 in any suitable manner within the scope of the present invention which allows the seat member to be moved between the positions shown in FIGS. 1*a*–1*d*.

The leg members 14, 16 may be of any suitable construction within the scope of the present invention. In one embodiment as shown in FIGS. 1*a*–1*d* and 4–9, each of the leg members 14, 16 comprises upper and lower leg portions 30 that are secured by bolts or other suitable means to an angled pivot plate or member 32 having a pivot opening 34 in the center portion thereof. The leg portions 30 are disposed in offset, generally parallel relation.

As shown in FIGS. 1*a*–1*d*, 8 and 9, the angled pivot plates 32 of the leg members 14 and 16 are disposed adjacent to each other with the pivot openings 34 thereof in alignment, and a pivot pin 36 is inserted through the openings 34 to pivotally connect each pair of leg members 14, 16. With this construction, the leg members 14, 16 are compact and strong, and also are very stable when they are opened to rest on each other in the support position shown in FIG. 1*d*.

The leg members 14, 16, support rods 18, seat member 20 and other components of the support bench 12 may be made of any suitable material, preferably a lightweight strong material such as aluminum or the like.

Figure 2:
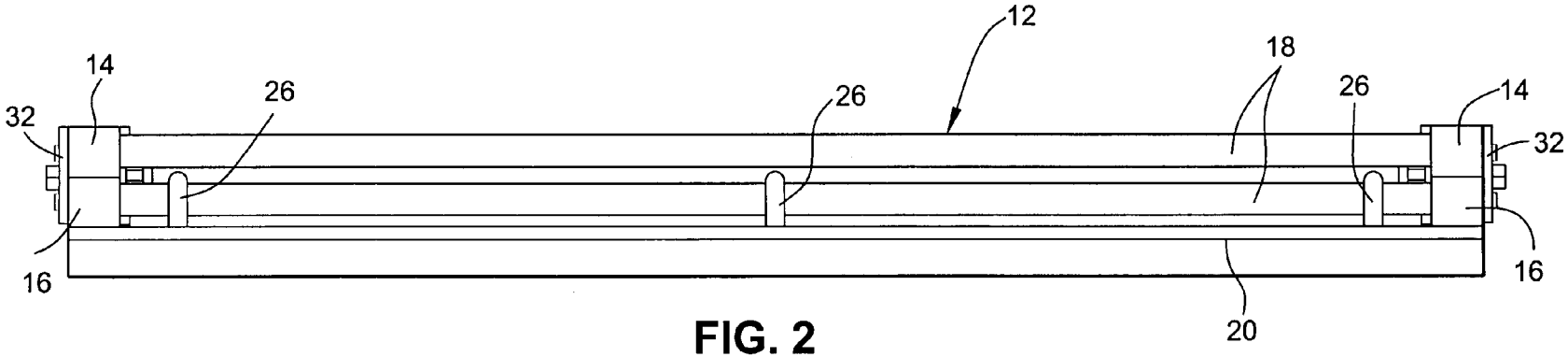
FIG. 2 is a top plan view of the portable exercise apparatus of the present invention, showing the support bench in a collapsed or storage position.

In accordance with the present invention, the upper and lower support rods 18 have attachment members 40 of any suitable construction mounted in spaced relation thereon in any suitable manner. In one embodiment, the attachment members 40 may be in the form of closed loop portions such that flexible and resilient resistance members or tubing or the like may be removably connected thereto for the performance of various exercises. As shown in FIGS. 2 and 3, a plurality of attachment devices 40 may be mounted in spaced relation on the upper and lower support rods 18, and preferably are mounted in laterally aligned relation thereon.

Figure 12:
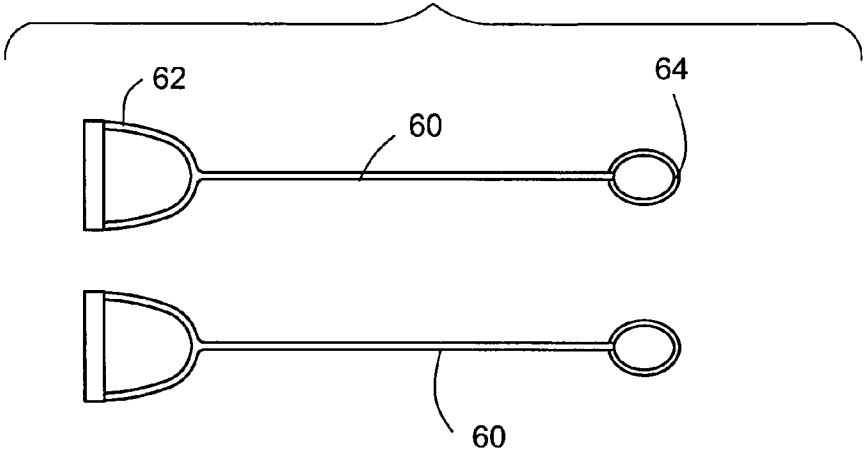
FIG. 12 is a top plan view of one type of resistance tubing that is usable with the support bench of the portable exercise apparatus of the present invention.
Figure 13:
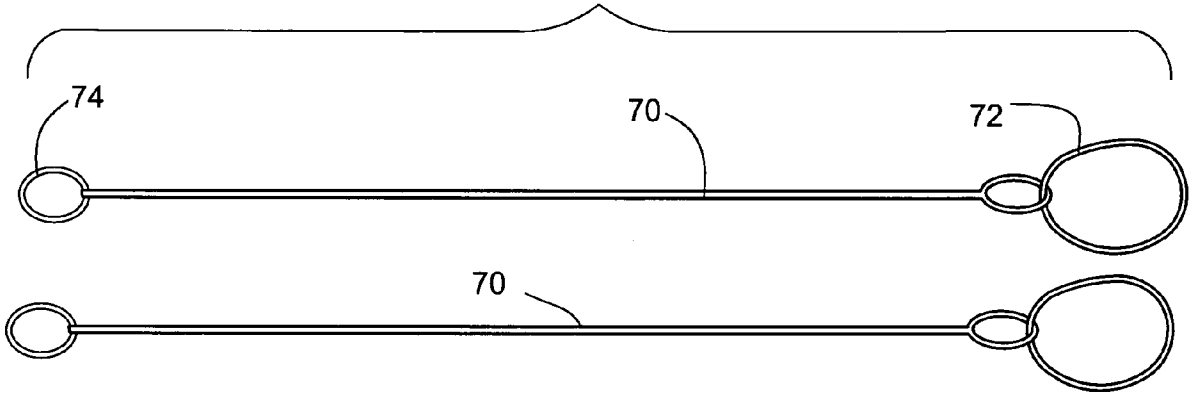
FIG. 13 is a top plan view of a second embodiment of resistance tubing that is usable with the support bench of the portable exercise apparatus of the present invention.

The resistance tubing may be of any suitable construction and different embodiments are shown in FIGS. 12 and 13. In the embodiment of FIG. 12, the elongated flexible or resilient tubing 60 has a handle 62 at one end and a looped portion 64 of any suitable construction at the other end which can be removably connected in any suitable manner to one of the attachment devices 40 on the support bench 12. In the embodiment shown in FIG. 13, the flexible and resilient tubing 70 has an adjustable loop portion 72 at one end thereof which can be gripped by the user and a connecting loop portion 74 at the other end thereof of any suitable construction that can be removably connected to one of the attachment devices 40.

For most exercises the resistance tubing 60, 70 is used in pairs that are removably connected to laterally aligned attachment devices 40 on both sides of the support bench 12.

Figure 15:
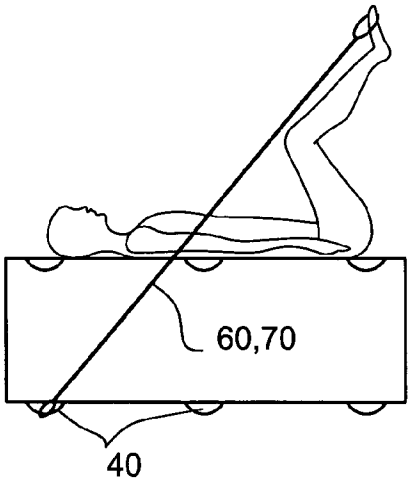
FIG. 15 is a front elevational view of the portable exercise apparatus of the present invention showing the manner in which a leg press would be performed thereon.
Figure 17:
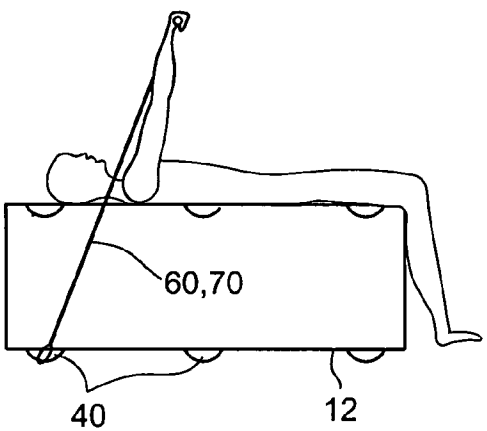
FIG. 17 is a front elevational view of the portable exercise apparatus of the present invention showing the manner in which a chest press would be performed thereon.
Figure 14:
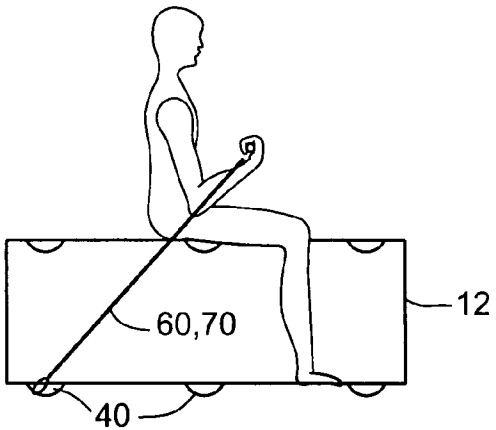
FIG. 14 is a schematic front elevational view of the portable exercise apparatus of the present invention showing the manner in which a biceps curl would be performed thereon.
Figure 16:
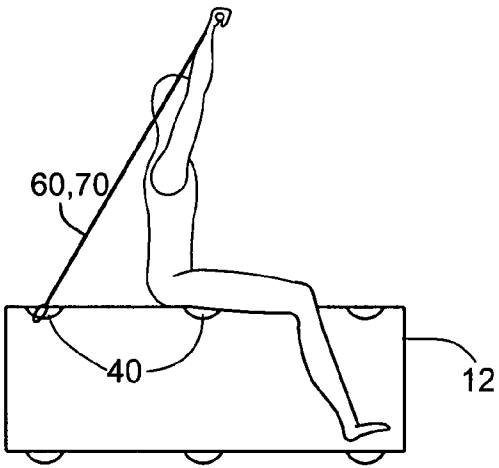
FIG. 16 is a front elevational view of the portable exercise apparatus of the present invention showing the manner in which a shoulder press would be performed thereon.

FIGS. 14–17 show schematically a few of the many exercises that may be performed on the portable exercise apparatus of the present invention by attaching the resistance tubing 60 or 70 to different attachment devices 40 on the support bench 12. FIG. 14 illustrates a biceps curl, FIG. 15 illustrates a leg press, FIG. 16 illustrates a shoulder press, and FIG. 17 illustrates a chest press, which are merely illustrative of the many different exercises that may be performed on the present apparatus.

Figure 18:
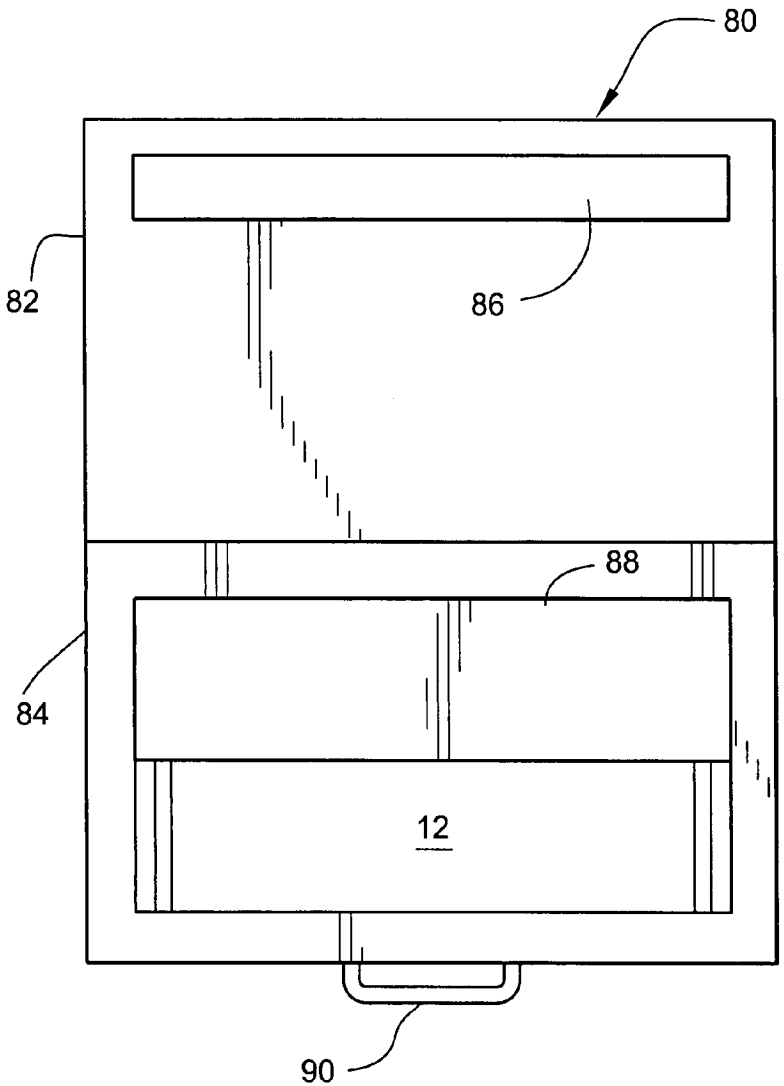
FIG. 18 is a top plan view of a storage case for the portable exercise apparatus of the present invention.

FIG. 18 illustrates one embodiment of a carrying case 80 that may be used for moving the collapsed support bench 12 of the present invention from one location to another. The carrying case 80 comprises two pivotally connected sections 82 and 84. The section 84 comprises a pocket 86 for receiving the resistance tubing 60 or 70, and the section 84 comprises a recessed portion 88 for receiving the collapsed bench 12. The carrying case 80 may be formed of any suitable material and may be of any suitable construction. The case may be provided with a handle 90.

From the foregoing description, it will be readily seen that the new and improved portable exercise apparatus of the present invention is simple in construction, reliable in operation, lightweight and collapsible to a very compact size such that it can be easily transported from one location to another. Also, the present apparatus is constructed to enable the user to perform a large number of exercises by merely attaching the resistance tubing to different attachment devices 40 on the support bench 12, as partially illustrated in FIGS. 14–17.

What is claimed is:

1. Portable exercise apparatus comprising:

a support bench having a pair of movably connected leg members at both ends thereof, said leg members being movable between a storage position wherein they are disposed adjacent to each other and in substantially parallel relation, and an open support position wherein the leg members are disposed at an angle to each other with their ends separated;

a generally laterally extending support rod connected to and extending between the upper and lower portions of each leg member on one end of said bench and the corresponding leg member on the opposite end of said bench wherein there are two upper support rods and two lower support rods disposed in substantially parallel relation;

a seat member movably connected to one of said upper support rods disposed adjacent thereto, said seat member being movable between a first position wherein it is disposed adjacent and substantially parallel to said leg members when they are in said storage position, and a second position wherein it extends across the upper portions of said leg members when they are in said open position and is supported on said upper support rods; and attachment devices mounted in spaced relation on the outer portions of said upper and lower support rods, said attachment devices being constructed to be connected to flexible and resilient resistance exercise members for the performance of different exercises on said support bench when said leg members are in said open support position and said seat member is in said second position.

2. The portable exercise apparatus of claim 1 wherein said attachment devices are generally laterally aligned on said support rods for connection to pairs of resistance exercise members.

3. The portable exercise apparatus of claim 1 wherein said leg members of each pair are pivotally connected at their midportions.

4. The portable exercise apparatus of claim 3 wherein each of said leg members comprises a central angled support plate and leg portions extending outwardly from said support plate and being disposed in offset, substantially parallel relation.

5. The portable exercise apparatus of claim 4 wherein the angled support plates of the adjacent leg members of each pair are pivotally connected together.

6. The portable exercise apparatus of claim 1 wherein said seat member is slidably and pivotally connected to said one upper support rod.

7. The portable exercise apparatus of claim 6 wherein said seat member comprises a plurality of substantially parallel tracks on the lower portion thereof, a plurality of pivot members are rotatably mounted on said one upper support rod and comprise pins that are slidably mounted in said tracks of said seat member, whereby said seat member can be moved from said first position to said second position by sliding it upwardly on said pins until they reach the lower portions of said tracks and then pivoting said seat member to said second position wherein it extends across said leg members and is supported on said upper support rods.

8. The portable exercise apparatus of claim 7 wherein the outer portion of said seat member has a pad thereon.

9. The portable exercise apparatus of claim 7 wherein said pivot members are generally annular in shape.

10. The portable exercise apparatus of claim 1 wherein said attachment devices are in the form of closed loop portions.

11. The portable exercise apparatus of claim 1 wherein said leg members and said support rods are formed of a lightweight, strong material.

12. The portable exercise apparatus of claim 11 wherein said leg members and said support rods are formed of aluminum.

13. The portable exercise apparatus of claim 1, further comprising a portable carrying case for supporting and enclosing said support bench when said leg members are in said storage position and said seat member is in said second position.

14. The portable exercise apparatus of claim 5, wherein said seat member is slidably and pivotally connected to said one upper support rod.

15. The portable exercise apparatus of claim 14 wherein said seat member comprises a plurality of substantially parallel tracks on the lower portion thereof, a plurality of pivot members are rotatably mounted on said one upper support rod and comprise pins that are slidably mounted in said tracks of said seat member, whereby said seat member can be moved from said first position to said second position by sliding it upwardly on said pins until they reach the lower portions of said tracks and then pivoting said seat member to said second position wherein it extends across said leg members and is supported on said upper support rods.

16. A method of performing different exercises on a portable support bench having pairs of movably connected leg members at both ends, said leg members being movable between a collapsed storage position and an open support position, generally laterally extending and substantially parallel support rods connected to and extending between the upper and lower portions of the leg members of each pair, and a seat member movably connected to one of the upper support rods disposed adjacent thereto and being movable between a storage position wherein it is disposed adjacent and substantially parallel to said collapsed leg members and a support position wherein it extends across the upper portions of said leg members and is supported by said upper support rods when said leg members are in said open support position, and attachment devices mounted in spaced relation on the outer portions of said upper and lower support rods;

said method comprising:

attaching one or more elongated flexible and resilient resistance exercise members to one or more of said attachment devices for the performance of different selected exercises on said support bench when said leg members and said seat member are in said support positions.

17. The method of claim 16 wherein said attachment devices are closed loop portions and are mounted in generally laterally aligned relation on the outer portions of said upper and lower support rods.

18. The method of claim 17 wherein said flexible and resilient resistance exercise members are formed of resistance tubing having a gripping portion at one end thereof and an attachment portion at the other end thereof constructed to be removably attached to one of said attachment devices.

19. The method of claim 18 wherein said resistance tubing is formed of rubber or plastic.

20. The method of claim 17 wherein said resistance exercise members are attached in pairs to laterally aligned attachment devices on the upper or lower support rods.

* * * * *